US005824264A

United States Patent [19]

Uno et al.

[11] Patent Number: 5,824,264

[45] Date of Patent: Oct. 20, 1998

[54] HIGH-TEMPERATURE STAINLESS STEEL AND METHOD FOR ITS PRODUCTION

[75] Inventors: Hideki Uno; Yoshitaka Nishiyama; Yoshiatsu Sawaragi; Nobuo Otsuka; Kazuhiro Ogawa; Toshiro Anraku, all of Nishinomiya, Japan

[73] Assignee: Sumitomo Metal Industries, Ltd., Osaka, Japan

[21] Appl. No.: 686,397

[22] Filed: Jul. 25, 1996

[51] Int. Cl.[6] ..... C22C 38/40

[52] U.S. Cl. ..... 420/40; 420/43; 148/611; 148/609; 148/327

[58] Field of Search ..... 420/40, 43; 148/611, 148/609, 327

[56] References Cited

U.S. PATENT DOCUMENTS

| | | | |
|---|---|---|---|
| 3,865,581 | 2/1975 | Sekino et al. | 420/43 |
| 4,224,062 | 9/1980 | Darnfors . | |
| 4,556,423 | 12/1985 | Kondo et al. . | |
| 5,000,801 | 3/1991 | Honkura et al. . | |
| 5,393,487 | 2/1995 | Matway et al. . | |

FOREIGN PATENT DOCUMENTS

| | | | |
|---|---|---|---|
| 51-76119 | 7/1976 | Japan . | |
| 54-56018 | 5/1979 | Japan . | |
| 158853 | 12/1981 | Japan | 420/40 |
| 59-185763 | 10/1984 | Japan . | |
| 226151 | 12/1984 | Japan | 420/40 |
| 60-230966 | 11/1985 | Japan . | |
| 63-213643 | 9/1988 | Japan . | |

OTHER PUBLICATIONS

Japanese Publication entitled "The Heat Resistant New Austenitic Stainless Steel NAR–AH–4", vol. 46, No. 5 (1994), pp. 87–91.

*Primary Examiner*—Deborah Yee

*Attorney, Agent, or Firm*—Burns, Doane, Swecker & Mathis, LLP

[57] ABSTRACT

A high-temperature austenitic stainless steel having improved weldability is disclosed. The steel consists essentially, by weight, of:

C: 0.05%–0.15%, Si: less than 1.0%, Mn: 2.0% or less, P: 0.04% or less, S: 0.01% or less, Cr: 20%–30%, Ni: 10%–15%, N: 0.10%–0.30%, B: 0.0010%–0.01%, one or two of La and Ce: 0.01%–0.10% in total, Al: 0.01%–0.20%, and a balance of Fe and incidental impurities, wherein the contents of N and Al satisfy the following inequality:

$$\%\ N+2\times\%\ Al \leqq 0.500\%$$

and the value for Ni balance (Ni bal.) of the steel calculated by the following formula is in the range of from −1.0% to +3.0%:

$$\text{Ni bal. }(\%)=\%\ Ni+0.5\times\%\ Mn+30\times(\%\ C+\%\ N)-1.1\times(\%\ Cr+1.5\times\%\ Si)+8.2.$$

12 Claims, 2 Drawing Sheets

HIGH-TEMPERATURE STAINLESS STEEL AND METHOD FOR ITS PRODUCTION

BACKGROUND OF THE INVENTION

The present invention relates to a high-temperature austenitic stainless steel having improved weldability and high temperature properties, and to a process for producing a hot-rolled steel product from such a steel.

In view of environmental protection, it has greatly been desired in recent years for evolution of polluting gases such as $NO_x$, $SO_x$, and $CO_2$ to be minimized. At the same time, in order to conserve fossil fuels, there has developed a need for efficient utilization of such fuels.

In order to satisfy these needs, industrial operations at high temperatures using fossil fuels in thermal power plants, chemical plants, and steel-manufacturing works, for example, tend to be conducted at increased temperatures. As a result, it becomes necessary for materials of such plants or installations used at high temperatures to have improved high temperature properties such as oxidation and corrosion resistance, erosion resistance, and creep strength at high temperatures, as well as improved weldability.

Austenitic stainless steels have been used as high-temperature structural materials for many years. Typical high-temperature austenitic stainless steels include high Cr-high Ni steels, e. g., 18Cr-8Ni steels such as JIS SUS 304, 25Cr-20Ni steels such as SUS 310S, and 20Cr-32Ni steel known as Alloy 800. Stainless steels with a high content of Si are also known to have improved high temperature properties. Examples of such steels are AISI302B, JISXM15JI, and AISI314. In addition, many types of stainless steels with improved high temperature properties are disclosed in Japanese Patent Application Laid-Open Specification No.4418/1977, Japanese Patent Publication Nos. 43370/1978, 12890/1979, 33207/1979, 17424/1981, 25507/1981, 16187/1982, 42701/1982, 54543/1982, 59299/1982, 2268/1983, 42264/1983, Japanese Patent Application Laid-Open Specification Nos. 185763/1984, 92454/1985, 69949/1988, 10 213643/1988, 69950/1988, 69951/1988, 157840/1988, 213643/1988, Japanese Patent Publication No.8695/1989, and Japanese Patent Application Laid-Open Specification No. 159351/1989, for example.

In the steels described in these references, improvement in high temperature properties can be achieved mainly by increasing the content of Si and in some cases by the addition of alloying elements such as Mo, Cu, N, Ti, and Nb.

An austenitic stainless steel disclosed in Japanese Patent Application Laid-Open Specification No. 69949/1988, for example, essentially contains Cu, but not Al so as to stabilize an austenitic phase. This is because non-magnetic properties must be maintained even after application of severe working. In addition, since the main purpose of the copper addition is to maintain non-magnetic properties, there is no mention in that disclosure of high temperature properties, such as creep strength. The addition of Cu has no effect on improvement in creep strength at a temperature higher than 800° C., but it does deteriorate high temperature ductility.

An austenitic stainless steel disclosed in Japanese Patent application Laid-Open Specification No. 69951/1988 allows the incorporation of Al in an amount of 0.05–1.0%, which is considered to be equivalent to Ti, V, and Nb with respect to effectiveness of refining crystal grains. In the working examples thereof, 0.5% or more of Al is added.

An austenitic stainless steel disclosed in Japanese Patent application Laid-Open Specification No. 157840/1988 requires the presence of delta-ferrite in an amount of 10–20% for the purpose of improving hot workability. A nickel-balance for the steels employed in the working examples can be calculated to be −1.9% to −3.4% in accordance with a formula of the present invention to be described below. That patent application, however, does not mention an Al content or high temperature properties of the resulting austenitic steels.

In general, 18Cr-8Ni system stainless steels are superior with respect to weldability and economy to others, but their high temperature properties such as resistance to oxidation at high temperatures are deteriorated. In contrast, high Cr-high Ni steels and high Si steels can exhibit improved resistance to oxidation, but they have less improved creep resistance properties as well as less improved weldability. Furthermore, such high Cr-high Ni steels have a high content of expensive Ni, resulting in problems with respect to cost.

SUMMARY OF THE INVENTION

Thus, an object of the present invention is to provide a less expensive austenitic stainless steel which can exhibit improved oxidation resistance at high temperatures, and improved erosion resistance and creep properties while exhibiting improved weldability.

Another object of the present invention is to provide a method of producing such an austenitic stainless steel.

The present invention provides an austenitic stainless steel having improved weldability, which consists essentially, by weight, of:

C: 0.05%–0.15%, Si: less than 1.0%, Mn: 2.0% or less,

P: 0.04% or less, S: 0.01% or less, Cr: 20%–30%,

Ni: 10%–15%, N: 0.10%–0.30%,

B: 0.0010%–0.01%, one or two of La and Ce: 0.01%–0.10% in total,

Al: 0.01%–0.20%, and a balance of Fe and incidental impurities, wherein the contents of N and Al satisfy the following inequality:

$$\%\ N+2\times\%\ Al \leqq 0.500\%$$

and the value for Ni balance (Ni bal.) of the steel calculated by the following formula is in the range of from −1.0% to +3.0%:

$$\text{Ni bal. }(\%)=\%\ Ni+0.5\times\%\ Mn+30\times(\%\ C+\%\ N)-1.1\times(\%\ Cr+1.5\times\%\ Si)+8.2$$

In another aspect, the present invention provides a method of producing an austenitic stainless steel product for use at high temperatures, comprising subjecting an ingot of a steel having a steel composition as defined before to slab making, hot rolling, and annealing, wherein the ingot is subjected to soaking for at least 2 hours in the temperature range of 1150°–1350° C. prior to slab making.

DESCRIPTION OF PREFERRED EMBODIMENTS OF THE INVENTION

Figure 1:
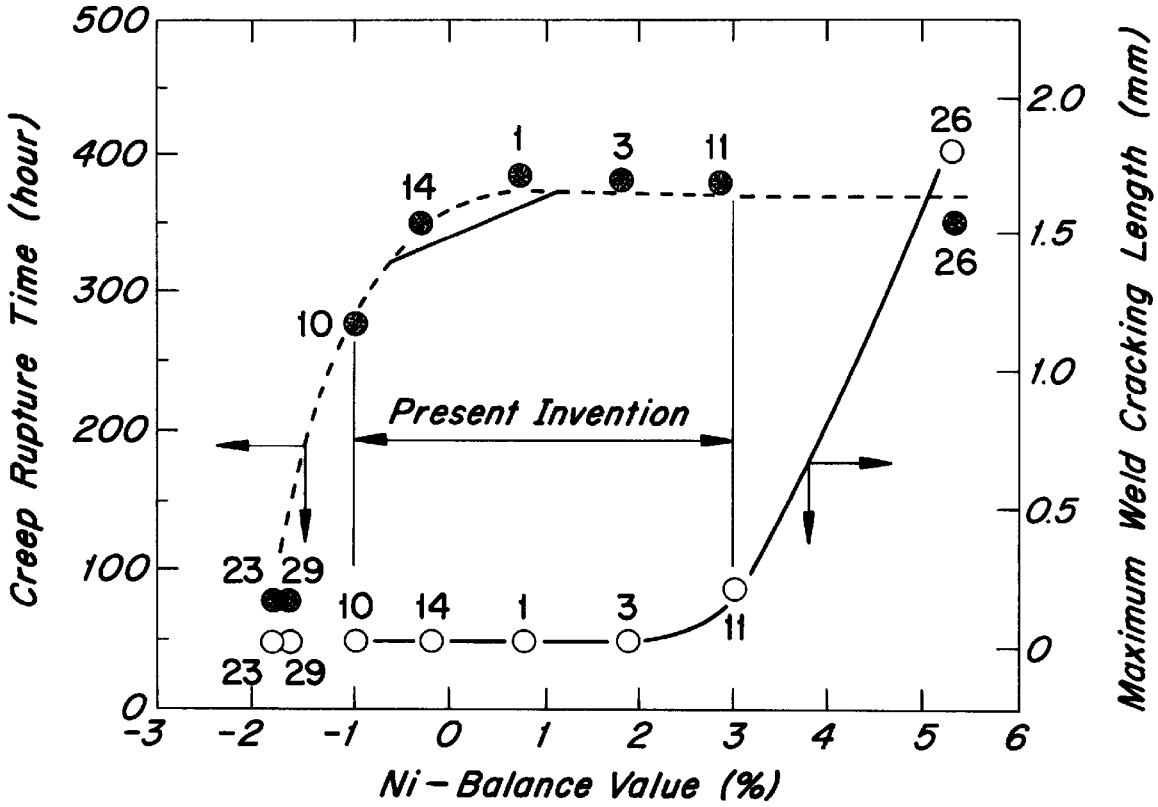
FIG. 1 is a graph showing the relationship of nickel balance to results of a creep rupture test and a maximum weld cracking length which is determined by the Trans-Varestraint test.

According to the present invention, an alloy composition and nickel balance as well as manufacturing conditions are defined as in the above for the following reasons.

C (carbon):

Carbon is effective not only for promoting stabilization of an austenitic structure but also for improving creep strength. When the carbon content is less than 0.05%, however, such improvement is not achieved. On the other hand, when the carbon content is larger than 0.15%, hot workability is degraded. Thus, according to the present invention, the carbon content is defined as 0.05–0.15%.

Si (silicon):

Si is added to molten steel as a deoxidizing agent. As the content of Si increases, the degradation of weldability and creep strength of the steel is marked. The Si content is, therefore, restricted to less than 1.0%. Preferably, the Si content is 0.4% or less.

Mn (manganese):

Mn is also a deoxidizing agent, and is effective for stabilizing an austenitic structure. However, since too much addition of Mn degrades the resistance to oxidation, the upper limit is defined as 2.0%. Preferably, the Mn content is restricted to 1.0% or less. More preferably, the Mn content is less than 0.5%.

P (phosphorous):

Incorporation of phosphorous should be avoided or kept to as low a level as possible in view of its adverse effect on weldability and creep strength. In contrast, the lower the P content the lower the productivity becomes, resulting in increased expense. Thus, the upper limit of P is defined as 0.04%.

S (sulfur):

Like phosphorous, sulfur also adversely affects weldability and creep strength. The lower the sulfur content the better. The upper limit thereof, therefore, is defined as 0.01% in view of productivity and costs of the resulting steel.

Cr (chromium):

Chromium is effective for improving high temperature resistance to oxidation, high temperature resistance to erosion, and creep strength. When less than 20% of Cr is added, however, its effect is very small. When the content of Cr is over 30%, stability of an austenitic structure is impaired, and hot workability is also degraded. Thus, the content of Cr is defined as at least 20% and at most 30%. Preferably, the Cr content is 21–25%.

Ni (nickel):

Nickel plays an important role in improving stability of an austenitic structure, resistance to oxidation and creep strength. When less than 10% of Ni is added, it does not produce any substantial effects. On the other hand, when more than 15% of Ni is added, weldability is degraded. Therefore, the content of Ni is defined as at least 10%, and at most 15%. Preferably, it is defined as 10% to 13%.

N (nitrogen):

Nitrogen is effective for improving stability of an austenitic structure and creep strength. The addition of less than 0.10% of N, however, has no effect on creep strength, and the addition of over 0.30% of N has an adverse effect on hot workability. Thus, the content of N is defined as at least 0.10% and at most 0.30%.

B (boron):

The addition of boron is effective for improving creep strength and hot workability. Boron in an amount of 0.0010% or more is effective. However, when boron is added in an amount of over 0.01%, hot workability tends to deteriorate. The boron content of the present invention is therefore defined as 0.0010–0.01%.

La (lanthanum)+Ce (cerium):

La and Ce are effective for improving resistance to oxidation and erosion resistance at high temperatures. When the total amount of La and Ce is less than 0.01%, they are not effective for this purpose. In contrast, when the amount is over 0.10%, hot workability and weldability are degraded. According to the present invention, the total content of La and Ce is therefore restricted to 0.01–0.1%.

The ratio of La to Ce or vice versa is not restricted to a particular level, since they are added in the form of a mixture such as mish metal.

Al (aluminum):

Al in an amount of 0.01% or more is added as a deoxidizer for promoting the effectiveness of La+Ce addition. The addition of an excess amount of Al deteriorates weldability and creep properties, so the upper limit of Al is restricted to 0.20%. Preferably, the upper limit of Al is 0.10%.

Ni-balance:

The nickel balance, which is defined by the following formula (1), determines the stability of an austenitic structure from a metallurgical viewpoint.

$$\text{Ni bal. } (\%) = \%\ \text{Ni} + 0.5\times\%\ \text{Mn} + 30\times(\%\ \text{C} + \%\ \text{N}) - 1.1\times(\%\ \text{Cr} + 1.5\times\%\ \text{Si}) + 8.2 \quad (1)$$

When the nickel balance is small, intermetallic compounds such as sigma-phase are easily precipitated at high temperatures, resulting in degradation of creep strength. On the other hand, when the nickel balance is high, weldability is degraded. Thus, in view of high temperature properties as well as weldability, the nickel balance is limited to at least −1.0% but at most 3.0%. Preferably, the nickel balance is 0.0% to +2.0%.

Furthermore, according to the present invention, the following relationship must be satisfied:

$$\text{N } (\%) + 2\ \text{Al } (\%) \leqq 0.500\% \quad (2)$$

When a large amount of N and Al is added to steel, AlN in undissolved form remains during solution treatment, resulting in fine crystal grains in steel. Such a fine structure causes degradation in creep rupture strength at high temperatures. In addition, there is another problem influencing stabilization of structure during high temperature service. Namely, even if AlN is dissolved perfectly in steel during solution treatment, it is expected that AlN will precipitate while the steel is used at high temperatures, since the service temperature is usually lower than the solution treatment temperature. Thus, if AlN precipitates during use of the steel, the amount of N which is dissolved in the steel decreases accordingly, and the Ni-balance value becomes small. As a result, brittle phases such as sigma-phases are easily precipitated, resulting in degradation in creep strength and ductility.

Thus, according to the present invention, for steels containing a relatively large amount of nitrogen, the amount of Al to be added as a deoxidizer is controlled precisely, and the amounts of Al and N satisfy the before-mentioned formula (2). Preferably, the amounts of Al and N to be added satisfy the following formula (3):

$$\text{N } (\%) + 2\ \text{Al } (\%) \leqq 0.350\% \quad (3)$$

Manufacturing process:

Soaking at a temperature range of 1150°–1350° C. is carried out so as to suppress to some extent segregation, which is usually experienced when a large-sized ingot is solidified, resulting in improvement in creep properties at high temperatures. In order for soaking to be effective in the above-mentioned temperature range, it can be continued for at least 2 hours.

After soaking, slab making and hot rolling may be carried out in a conventional manner, for example, depending on the purpose of the steel. A manufacturing method of the present invention, therefore, is not restricted to a specific one so long as the above-mentioned soaking is carried out.

The present invention will be explained in further detail in conjunction with working examples.

EXAMPLES

(Example 1)

The steel compositions shown in Table 1 were melted in a high frequency induction furnace (VIH, vacuum induced melting), and the resulting steel ingots (25 kg) were subjected to forging into slabs, hot rolling, and annealing.

Table 1 also shows results of an oxidation test in which heating to 1100° C. in air for 24 hours and then cooling to room temperature were repeated five cycles. Oxidation resistance was determined by a difference in specimen weight between after and before the cyclic heating test. Weight loss after testing was determined for each of the specimens. When the weight loss was less than 50 g/m$^2$, the specimen was evaluated as "good".

As is apparent from Table 1, all of the specimens of the present invention exhibited a weight loss of 50 g/m$^2$ or less, which means that the steel of the present invention can exhibit a marked level of improvement in oxidation resistance.

Table 1 still shows results of a high temperature erosion test in which specimens were blasted by synthetic silica sand in air at 700° C. The test continued for three hours, and the blasting rate of synthetic silica sand (ash concentration) was 20 mg/m$^3$. A reduction in thickness of less than 15 $\mu$m was evaluated as "good".

Specimens of the present invention steel exhibited a reduction in thickness of about 10 $\mu$m, which is less than that of comparative steels. This means that the steel of the present invention can exhibit improved high temperature erosion resistance.

As is apparent from experimental data in Table 1, Comparative Steels Nos. 18 and 22 can exhibit a relatively satisfactory level of oxidation resistance as well as erosion resistance, since they are high-Si steels or high-Cr, high-Ni steels.

Table 4 also shows results of a creep rupture test which was carried out at 900° C. under 3.5 kgf/mm$^2$ for the steels of the present invention and some of the comparative examples. Specimens exhibiting a rupture time of over 250 hours were evaluated as "good".

Specimens of the steel of the present invention exhibited a relatively long creep rupture time. This means that the steel of the present invention can exhibit improved creep strength. In contrast, comparative steels except for Steel Nos. 26 and 27, which had a high Ni-balance and a high content of N, respectively, exhibited less improved creep strength.

Table 1 further shows results of the Trans-Varestaint test, in which sensitivity to weld metal cracking at high temperatures was determined under strains of 2%. Specimens exhibiting a maximum length of 0.25 mm or less were evaluated as "good".

Specimens of the steel of the present invention were mostly free of cracking, and they exhibited improved resistance to weld metal cracking. In contrast, comparative steels except for specimens having a Ni-balance of less than −1% and Steel No. 30 having a low content of N, exhibited high sensitivity to weld metal cracking.

Comparative Steels Nos. 18 and 22, which exhibited a relatively good oxidation resistance as well as erosion resistance, are known to have degraded properties with respect to creep strength and sensitivity to weld metal cracking at high temperatures.

FIG. 1 is a graph of results of the creep rupture test and the Trans-Varestraint test, which are plotted with respect to the Ni-balance of the specimen. The creep rupture test was carried out at 900° C. under 3.5 kgf/mm$^2$ to determine rupture time. The Trans-Varestraint test was carried out using specimens measuring 4 mm×100 mm×100 mm. TIG welding was applied to a surface of the specimen under conditions of 100 A, 14 V, and a feed rate of 15 cm/min. After welding, a bending strain of 2% was applied to determine the maximum length of cracking. Numerical figures in the drawing correspond to specimen numbers in Table 1.

As is apparent from the graphs, the creep rupture time is decreased sharply when the Ni-balance deceases to less than −1%, and the maximum length of cracking is also drastically increased when the Ni balance is increased to over 3%. For this reason, a Ni-balance of the present invention which satisfies both creep properties and weldability is within the range of −1% to +3%.

TABLE 1

| Steel No. | Steel Composition (wt %) C | Si | Mn | P | S | Cr | Ni | N | B | La + Ce | Al | Ni bal | N + 2Al | wt. change after 5 cycles (g/m$^2$) | Abrasion loss ($\mu$m) | Creep rupture time (h) | Max. weld crack length (mm) |
|---|---|---|---|---|---|---|---|---|---|---|---|---|---|---|---|---|---|
| THIS INVENTION | | | | | | | | | | | | | | | | | |
| 1 | 0.052 | 0.31 | 0.51 | 0.018 | 0.0017 | 23.01 | 11.86 | 0.157 | 0.0015 | 0.039 | 0.028 | 0.76 | 0.213 | −13 | 10.5 | 387 | 0.00 |
| 2 | 0.068 | 0.29 | 0.49 | 0.022 | 0.0006 | 22.98 | 11.05 | 0.192 | 0.0022 | 0.040 | 0.037 | 1.54 | 0.266 | −15 | 10.3 | 380 | 0.00 |
| 3 | 0.145 | 0.30 | 0.52 | 0.021 | 0.0014 | 23.52 | 10.66 | 0.158 | 0.0024 | 0.038 | 0.026 | 1.84 | 0.210 | −9 | 10.8 | 385 | 0.00 |
| 4 | 0.078 | 0.82 | 0.47 | 0.019 | 0.0008 | 22.43 | 11.22 | 0.177 | 0.0022 | 0.035 | 0.032 | 1.28 | 0.241 | −7 | 9.1 | 327 | 0.10 |
| 5 | 0.063 | 0.29 | 1.86 | 0.018 | 0.0007 | 22.82 | 11.23 | 0.166 | 0.0030 | 0.040 | 0.034 | 1.65 | 0.234 | −31 | 12.3 | 263 | 0.10 |
| 6 | 0.070 | 0.31 | 0.47 | 0.032 | 0.0003 | 22.95 | 11.08 | 0.165 | 0.0035 | 0.034 | 0.032 | 0.81 | 0.229 | −16 | 10.5 | 390 | 0.00 |
| 7 | 0.058 | 0.30 | 0.49 | 0.003 | 0.0081 | 23.02 | 10.58 | 0.176 | 0.0028 | 0.041 | 0.030 | 0.23 | 0.236 | −15 | 10.2 | 262 | 0.20 |
| 8 | 0.068 | 0.33 | 0.48 | 0.019 | 0.0008 | 20.35 | 10.76 | 0.152 | 0.0035 | 0.046 | 0.039 | 2.87 | 0.230 | −37 | 12.6 | 335 | 0.20 |
| 9 | 0.072 | 0.30 | 0.52 | 0.019 | 0.0003 | 28.59 | 14.72 | 0.215 | 0.0025 | 0.032 | 0.029 | −0.15 | 0.273 | −2 | 5.7 | 286 | 0.00 |
| 10 | 0.060 | 0.30 | 0.44 | 0.018 | 0.0015 | 24.51 | 13.15 | 0.105 | 0.0021 | 0.036 | 0.034 | −0.94 | 0.173 | −8 | 9.0 | 277 | 0.00 |
| 11 | 0.056 | 0.30 | 0.47 | 0.022 | 0.0016 | 24.21 | 11.38 | 0.285 | 0.0022 | 0.034 | 0.025 | 2.92 | 0.335 | −12 | 8.2 | 384 | 0.20 |
| 12 | 0.068 | 0.28 | 0.48 | 0.021 | 0.0011 | 22.96 | 11.29 | 0.186 | 0.0012 | 0.036 | 0.034 | 1.63 | 0.254 | −21 | 10.6 | 356 | 0.00 |
| 13 | 0.069 | 0.29 | 0.45 | 0.021 | 0.0009 | 23.05 | 11.19 | 0.192 | 0.0087 | 0.041 | 0.042 | 1.61 | 0.276 | −16 | 10.2 | 382 | 0.00 |
| 14 | 0.068 | 0.46 | 0.51 | 0.019 | 0.0008 | 24.52 | 10.95 | 0.201 | 0.0025 | 0.012 | 0.028 | −0.26 | 0.257 | −36 | 12.1 | 351 | 0.00 |
| 15 | 0.072 | 0.31 | 0.53 | 0.018 | 0.0001 | 23.12 | 11.20 | 0.183 | 0.0032 | 0.083 | 0.031 | 1.37 | 0.245 | −5 | 8.8 | 393 | 0.10 |
| 16 | 0.070 | 0.28 | 0.58 | 0.015 | 0.0010 | 23.11 | 11.14 | 0.186 | 0.0028 | 0.041 | 0.015 | 1.43 | 0.216 | −14 | 10.2 | 385 | 0.00 |
| 17 | 0.069 | 0.29 | 0.52 | 0.023 | 0.0012 | 23.05 | 11.05 | 0.194 | 0.0026 | 0.044 | 0.089 | 1.57 | 0.372 | −8 | 10.4 | 284 | 0.00 |
| COMPARATIVE | | | | | | | | | | | | | | | | | |
| 18 | 0.072 | 2.03* | 0.50 | 0.019 | 0.0082 | 20.89 | 13.04 | 0.188 | 0.0035 | 0.022 | 0.035 | 2.96 | 0.258 | +15 | 14.5 | 60 | 1.20 |
| 19 | 0.068 | 0.35 | 2.21* | 0.053* | 0.0055 | 20.78 | 11.08 | 0.156 | 0.0032 | 0.015 | 0.036 | 3.67* | 0.228 | −257 | 21.0 | 93 | 0.80 |
| 20 | 0.068 | 0.31 | 0.51 | 0.020 | 0.0150* | 23.02 | 11.05 | 0.138 | 0.0025 | 0.029 | 0.038 | −0.15 | 0.214 | N.D. | N.D. | 89 | 1.60 |
| 21 | 0.051 | 0.82 | 0.53 | 0.022 | 0.0073 | 18.20* | 10.03 | 0.108 | 0.0028 | 0.025 | 0.039 | 1.89 | 0.186 | −502 | 25.3 | 56 | 0.70 |
| 22 | 0.053 | 0.58 | 1.21 | 0.023 | 0.0032 | 24.63 | 20.25* | 0.026* | 0.0006* | —* | 0.037 | 3.37* | 0.100 | −16 | 12.2 | 67 | 1.60 |
| 23 | 0.070 | 0.31 | 0.55 | 0.023 | 0.0010 | 23.35 | 9.15* | 0.155 | 0.0023 | 0.034 | 0.028 | −1.82* | 0.211 | N.D. | N.D. | 79 | 0.00 |
| 24 | 0.064 | 0.31 | 0.51 | 0.019 | 0.0012 | 20.45 | 11.03 | 0.188 | 0.0025 | 0.004* | 0.016 | 4.04* | 0.220 | −215 | 22.3 | 78 | 0.80 |
| 25 | 0.071 | 0.29 | 0.51 | 0.018 | 0.0028 | 21.09 | 11.45 | 0.153 | 0.0022 | 0.025 | 0.255* | 2.95 | 0.663* | −10 | 9.8 | 83 | 0.90 |
| 26 | 0.075 | 0.22 | 0.58 | 0.025 | 0.0022 | 20.98 | 14.86 | 0.108 | 0.0032 | 0.036 | 0.029 | 5.40* | 0.166 | −232 | 21.4 | 357 | 1.80 |
| 27 | 0.063 | 0.81 | 0.62 | 0.028 | 0.0008 | 25.24 | 10.86 | 0.350* | 0.0031 | 0.030 | 0.029 | 2.65 | 0.408 | −35 | 8.2 | — | 1.75 |
| 28 | 0.062 | 0.29 | 0.51 | 0.035 | 0.0031 | 22.98 | 10.85 | 0.250 | 0.0042 | 0.036 | 0.167 | 2.91 | 0.584* | −18 | 10.2 | — | 0.10 |
| 29 | 0.078 | 0.88 | 0.48 | 0.022 | 0.0007 | 24.32 | 10.55 | 0.170 | 0.0024 | 0.035 | 0.044 | −1.77* | 0.258 | −67 | 12.4 | — | 0.00 |
| 30 | 0.054 | 0.43 | 0.52 | 0.018 | 0.0012 | 21.15 | 12.88 | 0.030* | 0.0030 | 0.021 | 0.021 | −0.11 | 0.199 | −21 | 12.9 | — | 0.00 |

(Note)
*: Outside the range defined herein.

(Example 2)

The steel compositions shown in Table 2 were, on an industrial scale, melted, refined under vacuum, and cast into 8 ton ingots. After soaking or heating without soaking, hot ingots were subjected to slab making, hot rolling, and annealing. The resulting steels were subjected to a creep rupture test at 900° C. under 2.7 kgf/mm$^2$. Results are shown in Table 3.

From Table 3, it is noted that specimens which were subjected to soaking in accordance with the present invention exhibited a longer creep rupture time than the other specimens.

TABLE 2

| Steel | Steel Composition (wt %) | | | | | | | | | | | | |
|---|---|---|---|---|---|---|---|---|---|---|---|---|---|
| No. | C | Si | Mn | P | S | Cr | Ni | N | B | La + Ce | Al | Ni bal | N + 2xAl |
| 1 | 0.075 | 0.30 | 0.52 | 0.022 | 0.0003 | 23.04 | 11.45 | 0.187 | 0.0025 | 0.035 | 0.033 | 1.93 | 0.253 |
| 2 | 0.064 | 0.29 | 0.50 | 0.023 | 0.0002 | 23.50 | 10.87 | 0.138 | 0.0030 | 0.038 | 0.028 | −0.95 | 0.194 |

TABLE 3

| Steel No. | Soaking(Heating) Temp. (°C.) | Soaking(Heating) Time (h) | Rupture Time (h) | Remarks |
|---|---|---|---|---|
| 1 | 1180 | 10 | 1200 | Soaking applied |
| | 1250 | 3 | 1106 | |
| | 1250 | 7 | 1250 | |
| | 1320 | 2 | 1063 | |
| 2 | 1250 | 6 | 1125 | |
| | 1320 | 3 | 1065 | |
| 1 | — | — | 683 | No soaking |
| | 1180 | 1 | 705 | |
| 2 | 1250 | 1 | 575 | |
| | 1320 | 1 | 608 | |

(Example 3)

The steel compositions shown in Table 4 were melted and refined under vacuum in a high frequency induction furnace. The resulting ingots (25 kg) were forged into slabs and the slabs were hot rolled. Following hot rolling, solution treatment at 1130° C. was carried out. Oxidation resistance and high temperature strength were determined for these steels.

Oxidation Resistance:

One oxidation resistance test was carried out by continuously heating specimens at 1000° C. for 200 hours. Another oxidation resistance test was carried out by repeating 400 cycles, maximum, for a total of 200 continuous hours, each of the cycles comprising heating at 1000° C. for 25 minutes and air cooling for 5 minutes. Test results are shown in Table 5.

Oxidation resistance was evaluated based on the increase in weight including weight of removed oxide scales in the continuous heating test, and based on the difference in specimen weight after and before the cyclic heating test.

The increase in weight including weight of removed oxide scales after continuous heating for 200 hours was smaller than 50 g/m$^2$ for steel specimens of the present invention. In contrast, comparative specimens except for Nos. 24 (high Si) and 27 (high-Cr, high-Ni) exhibited less improved oxidation resistance.

Furthermore, the change in weight after 400 cyclic heating was within ±50 g/m$^2$ for the steels of the present invention. For comparative steels including low Cr steels and high Si steels which exhibited improved oxidation resistance in the continuous heating test, weight loss after cyclic heating was marked. This means that formation of oxide scales and removal thereof took place markedly during cyclic heating for comparative specimens.

High Temperature Strength:

Table 5 shows results of a creep rupture test carried out at 1000° C. under 1.0 kgf/mm$^2$. The specimens of the present invention exhibited a longer creep rupture time than the comparative specimens.

Figure 2:
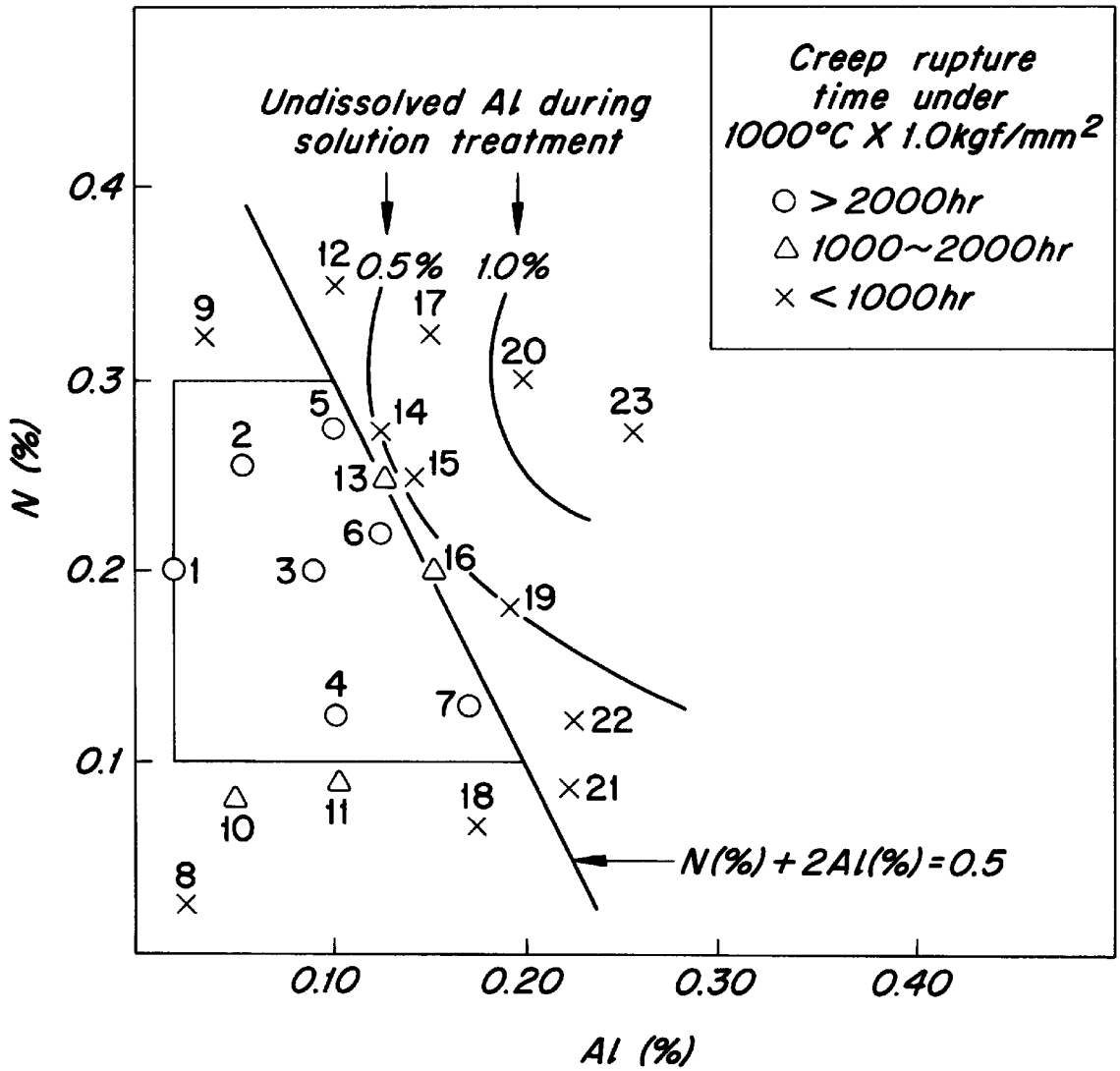
FIG. 2 is a graph of results of a creep rupture test carried out at 1000° C. under a stress of 1.0 kgf/mm$^2$, plotted as a function of Al content and N content.

FIG. 2 is a graph obtained by plotting creep rupture strength with respect to the Al content as abscissa and the N content as ordinate.

It is apparent from FIG. 2 that specimens with steel compositions satisfying the formula: N (%)+2Al (%)≦0.500 (%) exhibit improved creep properties. FIG. 2 also shows the amount of undissolved AlN remaining after solution treatment at 1130° C., i.e., Al and N as nitrides. Thus, it is also noted from FIG. 2 that creep properties are degraded when AlN remains. In other words, high temperature strength, creep elongation, and toughness can be further improved by controlling the amount of Al and N.

Weldability:

Results of the Trans-Varestraint test are shown in Table 5. The test was carried out to determine sensitivity to weld metal cracking at high temperatures. Of the comparative specimens, Steel No. 9 (high N steel), Steel Nos. 24 and 30, and other steels having an Ni-balance over +3.0% exhibited a relatively large length of cracking, indicating sensitivity to weld metal cracking.

Thus, according to the present invention, an austenitic structure of conventional high Cr-high Ni steels and high Si austenitic stainless steels which are used under high temperature conditions can be further stabilized markedly, resulting in an austenitic stainless steel with improved properties with respect to oxidation resistance at high temperatures. In addition, since the addition of Ni is suppressed to as low a level as possible, high temperature steels of the present invention are economical and can be used in a wide range of applications.

TABLE 4

| | Steel | Steel Composition (wt %) | | | | | | | | | | | | |
|---|---|---|---|---|---|---|---|---|---|---|---|---|---|---|
| | No. | C | Si | Mn | P | S | Cr | Ni | N | B | La + Ce | Al | Ni bal | N + 2 × Al |
| This Invention | 1 | 0.057 | 0.87 | 1.24 | 0.027 | 0.0017 | 22.38 | 11.86 | 0.205 | 0.0028 | 0.042 | 0.021 | 2.49 | 0.247 |
| | 2 | 0.068 | 0.34 | 0.49 | 0.018 | 0.0006 | 25.69 | 11.05 | 0.255 | 0.0039 | 0.032 | 0.054 | 0.36 | 0.363 |
| | 3 | 0.147 | 0.29 | 0.88 | 0.011 | 0.0014 | 22.00 | 10.66 | 0.124 | 0.0014 | 0.024 | 0.097 | 2.75 | 0.318 |
| | 4 | 0.070 | 0.33 | 0.88 | 0.035 | 0.0025 | 23.89 | 11.31 | 0.208 | 0.0037 | 0.013 | 0.085 | 1.47 | 0.378 |
| | 5 | 0.058 | 0.67 | 0.52 | 0.022 | 0.0007 | 25.47 | 11.32 | 0.276 | 0.0032 | 0.042 | 0.100 | 0.65 | 0.475 |
| | 6 | 0.062 | 0.32 | 0.66 | 0.018 | 0.0012 | 23.19 | 11.08 | 0.220 | 0.0014 | 0.021 | 0.124 | 2.03 | 0.468 |
| | 7 | 0.142 | 0.47 | 0.79 | 0.005 | 0.0081 | 24.59 | 10.58 | 0.127 | 0.0021 | 0.066 | 0.171 | −0.58 | 0.469 |
| Comparative | 8 | 0.204* | 0.25 | 0.48 | 0.024 | 0.0008 | 22.39 | 10.76 | 0.025 | 0.0059 | 0.087 | 0.024 | 1.03 | 0.073 |
| | 9 | 0.072 | 0.33 | 0.52 | 0.049 | 0.0003 | 28.59 | 14.72 | 0.322* | 0.0089 | 0.034 | 0.034 | 3.00 | 0.390 |
| | 10 | 0.060 | 0.41 | 0.32 | 0.022 | 0.0015 | 24.11 | 13.15 | 0.080* | 0.0076 | 0.011 | 0.048 | −1.48* | 0.176 |
| | 11 | 0.056 | 0.33 | 0.44 | 0.017 | 0.0016 | 20.19 | 11.38 | 0.088* | 0.0049 | 0.088 | 0.100 | 1.37 | 0.288 |
| | 12 | 0.068 | 0.24 | 0.48 | 0.015 | 0.0011 | 22.39 | 11.29 | 0.351* | 0.0012 | 0.036 | 0.102 | 7.28* | 0.555* |
| | 13 | 0.069 | 0.24 | 0.45 | 0.011 | 0.0009 | 23.54 | 11.19 | 0.253 | 0.0087 | 0.041 | 0.124 | 2.99 | 0.501* |
| | 14 | 0.097 | 0.36 | 0.57 | 0.019 | 0.0008 | 24.59 | 10.95 | 0.278 | 0.0034 | 0.120* | 0.122 | 3.04* | 0.522* |
| | 15 | 0.072 | 0.57 | 0.66 | 0.015 | 0.0001 | 23.12 | 11.20 | 0.247 | 0.0019 | 0.045 | 0.140 | 2.93 | 0.527* |
| | 16 | 0.175* | 0.87 | 0.58 | 0.023 | 0.0010 | 23.11 | 11.14 | 0.198 | 0.0190* | 0.025 | 0.153 | 3.96* | 0.504* |
| | 17 | 0.069 | 0.49 | 0.66 | 0.037 | 0.0012 | 23.05 | 11.05 | 0.322* | 0.0059 | 0.021 | 0.149 | 5.15* | 0.620* |
| | 18 | 0.072 | 0.77 | 0.50 | 0.046* | 0.0082 | 20.89 | 13.04 | 0.065* | 0.0059 | 0.022 | 0.176 | 1.35 | 0.417 |
| | 19 | 0.068 | 0.10 | 2.21* | 0.059* | 0.0055 | 20.78 | 11.08 | 0.180 | 0.0079 | 0.015 | 0.193 | 4.80* | 0.566* |
| | 20 | 0.187* | 0.33 | 0.51 | 0.020 | 0.0069 | 23.02 | 11.05 | 0.297 | 0.0150* | 0.029 | 0.200 | 8.16* | 0.697* |
| | 21 | 0.051 | 0.79 | 0.53 | 0.022 | 0.0073 | 20.19 | 10.03 | 0.083* | 0.0048 | 0.025 | 0.223* | −1.00 | 0.529* |
| | 22 | 0.053 | 0.76 | 1.21 | 0.023 | 0.0032 | 24.63 | 14.58 | 0.128 | 0.0005* | 0.024 | 0.226* | 0.47 | 0.580* |
| | 23 | 0.070 | 0.12 | 0.47 | 0.023 | 0.0010 | 23.35 | 13.25 | 0.275 | 0.0023 | 0.034 | 0.257* | 6.15* | 0.789* |
| | 24 | 0.064 | 1.50* | 0.50 | 0.019 | 0.0012 | 20.45 | 11.03 | 0.214 | 0.0025 | 0.031 | 0.016 | 2.85 | 0.246 |
| | 25 | 0.071 | 0.48 | 0.49 | 0.018 | 0.0028 | 21.09 | 11.45 | 0.189 | 0.0022 | —* | 0.054 | 3.70* | 0.297 |
| | 26 | 0.098 | 0.46 | 0.80 | 0.024 | 0.0250* | 16.50* | 10.98 | 0.246 | 0.0009* | 0.024 | 0.049 | 10.99* | 0.344 |
| | 27 | 0.047* | 0.55 | 0.45 | 0.026 | 0.0089 | 34.50* | 14.25 | 0.189 | —* | 0.029 | 0.089 | −9.10* | 0.367 |
| | 28 | 0.034* | 0.24 | 0.69 | 0.037 | 0.0014 | 23.48 | 7.54* | 0.216 | 0.0014 | 0.049 | 0.124 | −2.64* | 0.464 |
| | 29 | 0.050 | 0.58 | 1.21 | 0.023 | 0.0010 | 24.63 | 20.25* | 0.002* | 0.0006* | —* | 0.037 | 2.56 | 0.076 |
| | 30 | 0.062 | 1.88* | 0.52 | 0.023 | 0.0011 | 21.28 | 11.12 | 0.210 | 0.0030 | 0.021 | 0.021 | 1.23 | 0.252 |
| | 31 | 0.065 | 0.66 | 0.78 | 0.012 | 0.0008 | 22.00 | 12.78 | 0.230 | 0.0013 | 0.033 | 0.033 | 4.93* | 0.296 |
| | 32 | 0.051 | 0.66 | 0.38 | 0.032 | 0.0021 | 24.55 | 10.21 | 0.200 | 0.0078 | 0.049 | 0.044 | −1.96* | 0.288 |

(Note)
*: Outside the range defined herein.

TABLE 5

| Steel No. | Weight gain after 1000° C. × 200 hr ($g/m^2$) | Weight gain after 400 cycles ($g/m^2$) | 1000° C. × 1.0 $kgf/mm^2$ Creep rupture time (h) | Max. weld crack length (mm) |
|---|---|---|---|---|
| This invention | | | | |
| 1 | +28 | +24 | 2665 | 0.20 |
| 2 | +17 | −16 | 3450 | 0.00 |
| 3 | +22 | −9 | 2759 | 0.20 |
| 4 | +27 | −40 | 2380 | 0.10 |
| 5 | +32 | −35 | 3198 | 0.00 |
| 6 | +7 | +15 | 2900 | 0.10 |
| 7 | +14 | +21 | 2454 | 0.00 |
| Comparative | | | | |
| 8 | +18 | −11 | 521 | 0.10 |
| 9 | +25 | −35 | 810 | 0.80 |
| 11 | +39 | −10 | 730 | 0.10 |
| 12 | +21 | −9 | 845 | 0.10 |
| 13 | +28 | +3 | 1820 | 0.50 |
| 15 | +22 | −26 | 992 | 0.20 |
| 23 | +14 | +2 | 871 | 0.80 |
| 24 | +18 | −125 | — | 1.20 |
| 25 | +52 | −160 | — | — |
| 26 | +92 | −250 | — | — |
| 27 | +33 | −32 | 1331 | 1.80 |
| 28 | +72 | −90 | — | — |
| 29 | +45 | −60 | — | — |
| 30 | +17 | −105 | 970 | 1.60 |
| 31 | +38 | −15 | 2720 | 1.50 |

TABLE 5-continued

| Steel No. | Weight gain after 1000° C. × 200 hr ($g/m^2$) | Weight gain after 400 cycles ($g/m^2$) | 1000° C. × 1.0 $kgf/mm^2$ Creep rupture time (h) | Max. weld crack length (mm) |
|---|---|---|---|---|
| 32 | +32 | −30 | 1210 | 0.30 |

What is claimed is:

1. A high-temperature austenitic stainless steel having improved weldability, which consists essentially, by weight, of:

C: 0.05%–0.15%, Si: less than 1.0%, Mn: 2.0% or less, P: 0.04% or less, S: 0.01% or less, Cr: 20%–30%, Ni: 10%–15%, N: 0.10%–0.30%,

B: 0.0010%–0.01%, one or two of La and Ce: 0.01%–0.10% in total,

Al: 0.01%–0.20%, and a balance of Fe and incidental impurities, wherein the contents of N and Al satisfy the following inequality:

$$\% N+2\times\% Al \leqq 0.500\%$$

and the value for Ni balance (Ni bal.) of the steel calculated by the following formula is in the range of from −1.0% to +3.0%:

Ni bal. (%)=% Ni+0.5×% Mn+30×(% C+% N)−1.1×(% Cr+1.5×% Si)+8.2.

2. A high-temperature austenitic stainless steel set forth in claim 1 wherein the Si content is 0.4% or less.

3. A high-temperature austenitic stainless steel set forth in claim 1 wherein the Mn content is 1.0% or less.

4. A high-temperature austenitic stainless steel set forth in claim 1 wherein the Cr content is 21–25%.

5. A high-temperature austenitic stainless steel set forth in claim 1 wherein the Ni content is larger than 10% but not larger than 13%.

6. A high-temperature austenitic stainless steel set forth in claim 1 wherein N (%)+2Al (%)≦0.350%.

7. A high-temperature austenitic stainless steel set forth in claim 1 wherein the Ni-balance is 0.0% to +2.0%.

8. A method of producing an austenitic stainless steel product for use at high temperatures, comprising subjecting an ingot of a steel having the composition set forth in claim 1 to slab making, hot rolling, and annealing, wherein the ingot is subjected to soaking for at least 2 hours in the temperature range of 1150°–1350° C. prior to slab making.

9. A high-temperature austenitic stainless steel set forth in claim 1, wherein the Mn content is 0.5% or less.

10. A high-temperature austenitic stainless steel set forth in claim 1, wherein the N content is 0.1 to 0.3%.

11. A high-temperature austenitic stainless steel set forth in claim 1, wherein the Al content is 0.01 to 0.1%.

12. A high-temperature austenitic stainless steel set forth in claim 1, wherein the C content is 0.07 to 0.015%.

* * * * *